US007128641B1

(12) United States Patent
Lin

(10) Patent No.: US 7,128,641 B1
(45) Date of Patent: Oct. 31, 2006

(54) GRINDER CAPABLE OF SEIZING ROTARY SHAFT

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 11/147,298

(22) Filed: Jun. 8, 2005

(51) Int. Cl.
*B24B 23/00* (2006.01)

(52) U.S. Cl. ..... 451/359; 451/357

(58) Field of Classification Search ..... 451/357, 451/359

See application file for complete search history.

(56) References Cited

U.S. PATENT DOCUMENTS 3,334,448 A * 8/1967 Alexander ..... 451/359
4,400,995 A * 8/1983 Palm ..... 74/527
5,040,340 A * 8/1991 Bischof et al. ..... 451/357
5,464,365 A * 11/1995 Kirn ..... 451/344
5,601,483 A * 2/1997 Rudolf et al. ..... 451/359
5,679,066 A * 10/1997 Butz et al. ..... 451/357
6,386,961 B1 * 5/2002 Cureton ..... 451/358
6,485,360 B1 * 11/2002 Hutchins ..... 451/357
6,726,553 B1 * 4/2004 Tiede et al. ..... 451/357
6,780,093 B1 * 8/2004 Krondorfer et al. ..... 451/344
6,869,346 B1 * 3/2005 Wendt et al. ..... 451/342
6,887,142 B1 * 5/2005 Rupprecht et al. ..... 451/359
6,890,247 B1 * 5/2005 Dehde ..... 451/359

FOREIGN PATENT DOCUMENTS

DE 3120871 * 12/1982

* cited by examiner

*Primary Examiner*—Eileen P. Morgan
(74) *Attorney, Agent, or Firm*—Troxell Law Office, PLLC

(57) ABSTRACT

A grinder having a rotary shaft and a grinding disc mounted at a bottom end of the rotary shaft for grinding a work piece. A press button unit is disposed on a housing of the grinder. By means of pressing the press button unit, the rotary shaft of the grinder can be seized for replacement of the grinding disc. Before pressing the press button unit, a user must first angularly displace the press button unit. That is, the press button unit cannot be directly pressed without being first turned by a certain angle. Therefore, in operation, mis-touch of the press button unit can be avoided so as to avoid damage of the grinder.

18 Claims, 8 Drawing Sheets

GRINDER CAPABLE OF SEIZING ROTARY SHAFT

BACKGROUND OF THE INVENTION

The present invention is related to a grinding apparatus, and more particularly to a grinder having a press button. By means of pressing the press button, the rotary shaft of the grinder can be seized for replacement of the grinding disc. The press button is prevented from being mis-touched by a user so as to avoid damage of the grinder.

A conventional grinder such as a pneumatic grinder or an electric grinder is equipped with a grinding disc at bottom end for grinding a work piece.

When replacing the grinding disc, a user needs to chuck the rotary shaft with one wrench and wrench the nut at bottom end of the rotary shaft with another wrench. After the nut is untightened, the original grinding disc can be taken off and a new grinding disc can be fitted on the rotary shaft. Then the nut is retightened to fix the new grinding disc.

It is inconvenient to operate two wrenches at the same time. In order to solve this problem, an improved grinder has been developed. A chucking press button is disposed on the housing of the grinder. When pressed, the press button is moved into the interior of the grinder to chuck the rotary shaft. Under such circumstance, when replacing the grinding disc, a user only needs to wrench the nut with one wrench.

However, the above chucking press button is often incautiously mis-touched in operation. Under such circumstance, the rotary shaft will be suddenly seized by the press button. This will lead to damage of the grinder.

SUMMARY OF THE INVENTION

It is therefore a primary object of the present invention to provide a grinder capable of seizing rotary shaft. The grinder is equipped with a press button unit for chucking the rotary shaft of the grinder. The press button must be first turned and then pressed for seizing the rotary shaft. In case the press button unit is unexpectedly or incautiously mis-touched in operation, the rotary shaft will not be suddenly seized. This avoids damage of the grinder.

The present invention can be best understood through the following description and accompanying drawings wherein:

DETAILED DESCRIPTION OF THE PREFERRED EMBODIMENTS

Figure 2:
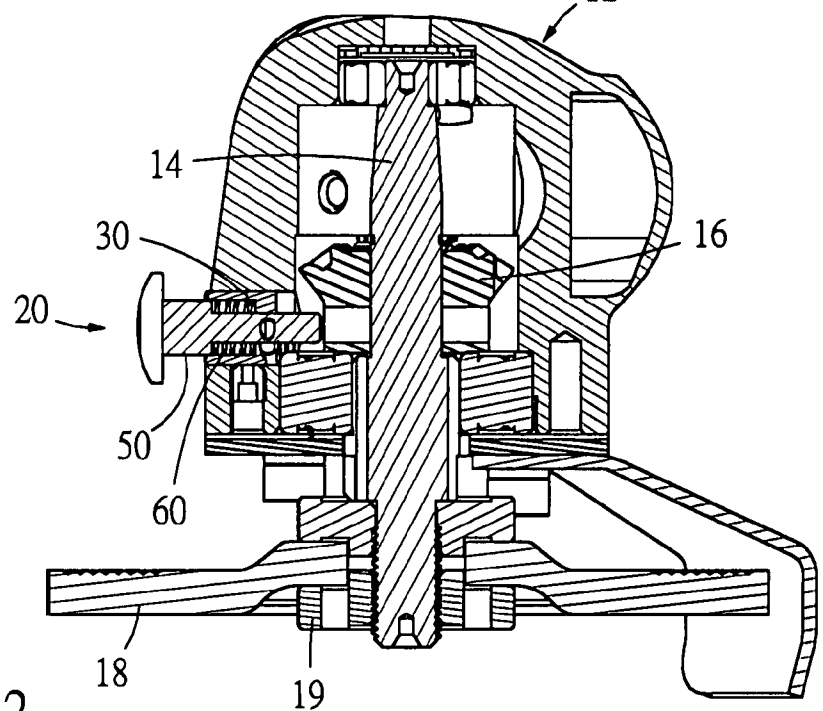
FIG. 2 is a sectional view taken along line 2—2 of FIG. 1.
Figure 1:
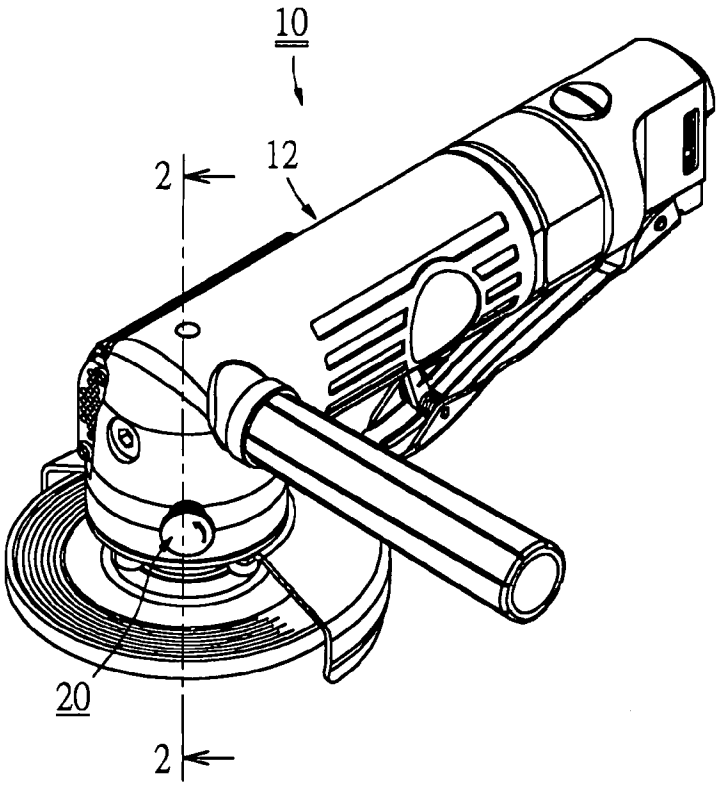
FIG. 1 is a perspective assembled view of a preferred embodiment of the present invention.

Please refer to FIGS. 1 and 2. According to a preferred embodiment, the grinder 10 of the present invention can be a pneumatic grinder or an electric grinder. A driving shaft is disposed in the housing 12 of the grinder 10 and drivable by a driving mechanism. (In the case of pneumatic grinder, the driving mechanism is a rotor, while in the case of electric grinder, the driving mechanism is a motor.) The driving shaft serves to drive a rotary shaft 14. In this embodiment, the driving shaft is drivingly engaged with the rotary shaft 14 via bevel gears 16. A grinding disc 18 is fitted at bottom end of the rotary shaft 14 and tightened with a nut 19. A press button unit 20 is arranged on the housing 12 for chucking the rotary shaft 14.

Figure 4:
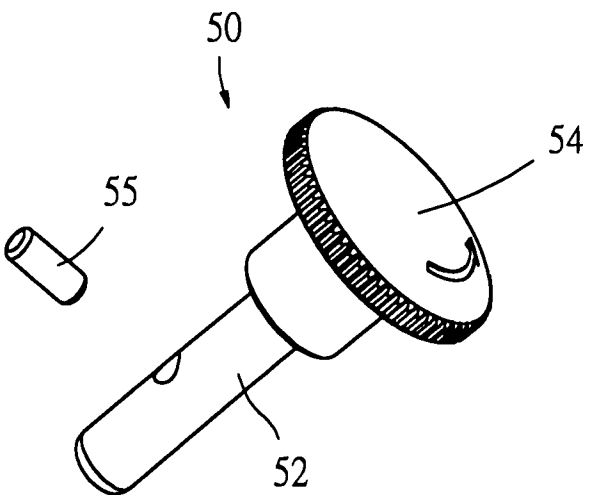
FIG. 4 is a perspective exploded view according to FIG. 3.
Figure 4:
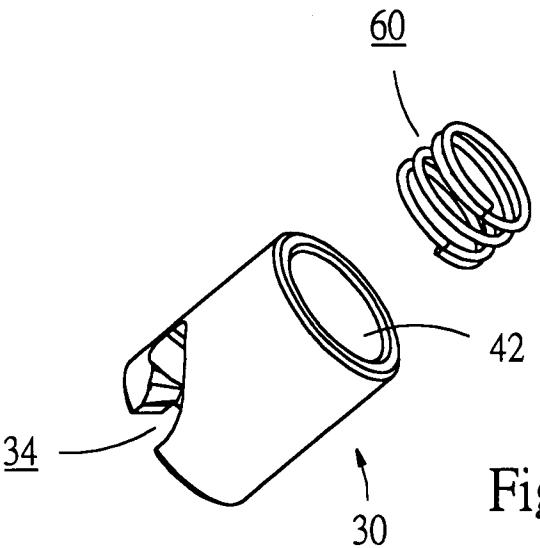
Figure 3:
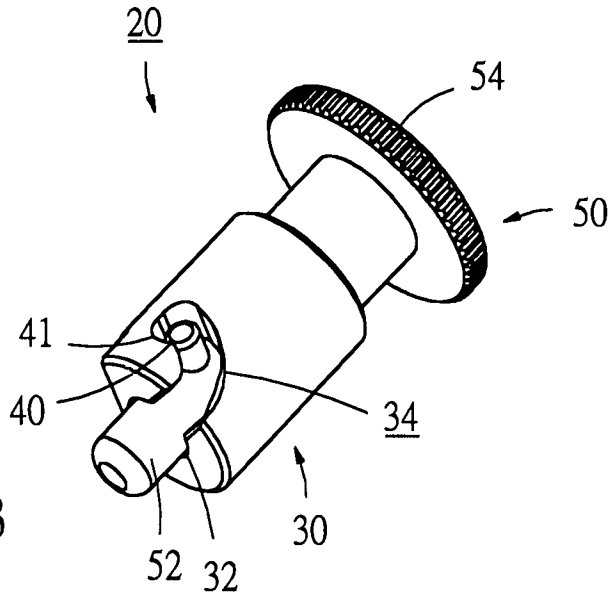
FIG. 3 is a perspective view of the press button unit of the preferred embodiment of the present invention.
Figure 5:
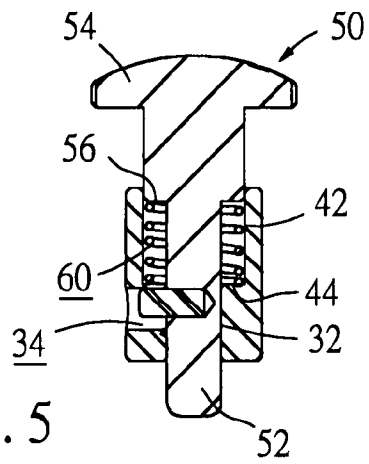
FIG. 5 is a longitudinal sectional view according to FIG. 3.

Referring to FIGS. 3 to 5, the press button unit 20 includes a cylindrical button seat 30, a press button member and a resilient mechanism.

Figure 6:
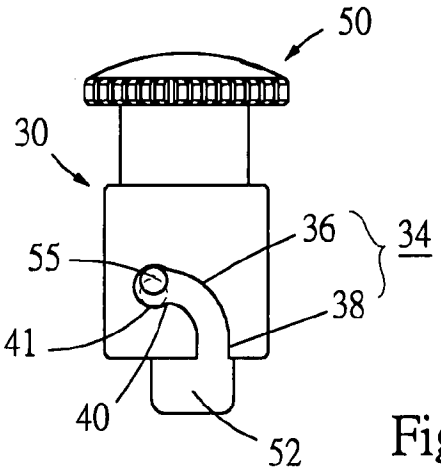
FIG. 6 is a front view according to FIG. 3.

The cylindrical button seat 30 is formed with an axial tunnel 32 passing through the button seat 30 from inner end to outer end thereof. A guide slot 34 is formed on the circumferential wall of the button seat 30. Two ends of the guide slot 34 are both axially and radially displaced from each other. The guide slot 34 includes an arc part 36 and a straight part 38 as shown in FIG. 6. The straight part 38 is located at a rear section of the guide slot and parallel to the axis of the button seat. A restricting portion 40 swells from rear wall of the guide slot 34 and is adjacent to front end of the guide slot. The restricting portion 40 and the front end of the guide slot define therebetween a depression 41.

The press button member is a button stem in this embodiment. The button stem has a stem body 52 and a cap portion 54 disposed at outer end of the stem body. A guide pin 55 is inserted in the stem body 52. The button stem 50 is movably fitted through the tunnel 32 of the button seat 30. Two ends of the button stem respectively protrude from two ends of the button seat. The guide pin 55 is received in the guide slot 34.

The resilient mechanism is a compression spring 60 fitted on the stem body 52 of the button stem 50. The tunnel 32 of the button seat 30 has a large diameter cavity 42 in which the spring 60 is accommodated. Two ends of the spring 60 respectively abut against a shoulder 44 formed in the button seat and a shoulder 56 of the stem body 52 as shown in FIG. 5. The spring 60 resiliently pushes the button stem 50, whereby the button stem 50 tends to move toward the front end of the button seat 30.

The button seat 30 of the press button unit 20 is fixedly disposed on the housing 12 of the grinder 10. The inner end of the button stem 50 is positioned inside the housing, while the outer end of the button stem 50 is positioned outside the housing. Referring to FIGS. 3 and 6, in common state, the button stem 50 is pushed by the spring 60 and positioned in a releasing position. At this time, the guide pin 55 of the button stem is located at the front end of the guide slot 34. In the releasing position, as shown in FIG. 2, the button stem 50 will not chuck the rotary shaft 14.

When seizing the rotary shaft, the button stem 50 must be moved into the grinder. The present invention does not allow a user directly press the button stem. Referring to FIG. 6, in the case that a user directly presses the button stem 50, the guide pin 55 will be moved toward the depression 41 and stopped by the restricting portion 40 as shown by the phantom line of FIG. 6.

Figure 7:
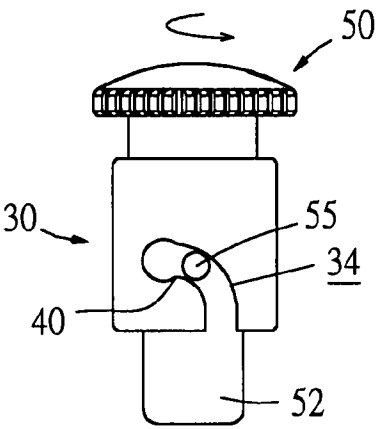
FIGS. 7 and 8 are front views according to FIG. 6, showing the operation of the press button unit of FIG. 3.
Figure 8:
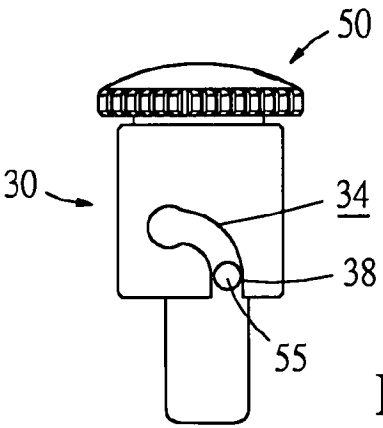
Figure 9:
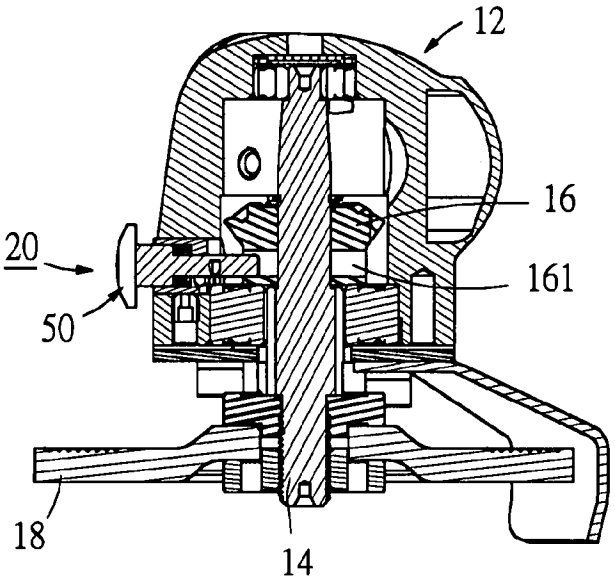
FIG. 9 shows that the rotary shaft of the grinder is seized.

Referring to FIG. 7, it is necessary to first turn and angularly displace the button stem 50 as shown in FIG. 7. When the button stem is turned by a certain angle to make the guide pin 55 pass over the restricting portion 40, a user can press the button stem 50. At this time, the button stem is guided by the guide slot 34 and is moved along the tunnel 32 toward the inner end of the button seat 30. When the guide pin 55 of the button stem reaches the straight part 38 of rear end of the guide slot 34, the button stem is positioned in a seizing position as shown in FIG. 8. Referring to FIG. 9, in the seizing position, the button stem 50 is moved into the housing 12 and the inner end of the button stem 50 is inserted into an insertion hole 161 of a bevel gear 16. Accordingly, the rotary shaft 14 cannot rotate and a user can wrench the nut 19 at the bottom end of the rotary shaft with a wrench for replacing the grinding disc 18.

After the replacement is completed, the button stem 50 is released from the pressing force. The spring 60 pushes the button stem back from the seizing position to its home releasing position as shown in FIGS. 3 and 6, and the rotary shaft 14 is no more seized. When the button stem 50 is restored, the guide pin 55 is moved along the guide slot 34.

According to the above arrangement, when seizing the rotary shaft, a user needs to purposely turn the button stem first and then press the button stem. The rotary shaft cannot be seized by means of directly pressing the button stem. Therefore, the present invention provides a security effect. In case the press button unit is unexpectedly or incautiously mis-touched in operation, the rotary shaft will not be seized. This avoids damage of the components of the grinder.

Figure 10:
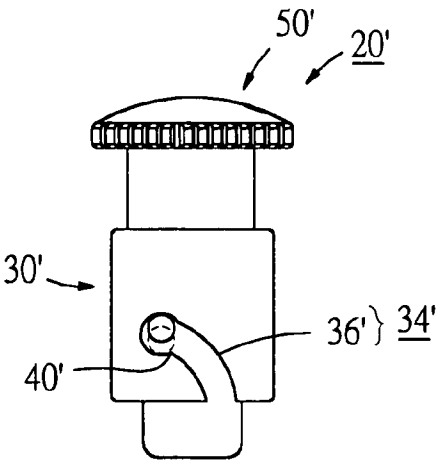
FIG. 10 is a front view of the press button unit of another embodiment of the present invention.

FIG. 10 shows the press button unit 20' of another embodiment of the present invention, which is substantially identical to FIG. 3. The only difference between this embodiment and the first one is that the guide slot 34' of the button seat 30' is totally an arc slot 36' without straight part.

After the button stem 50' is turned to make the guide pin 55' pass over the restricting portion 40', no matter whether the button stem is turned or pressed, the button stem can be axially moved along the axis of the button seat to reach the seizing position.

Figure 11:
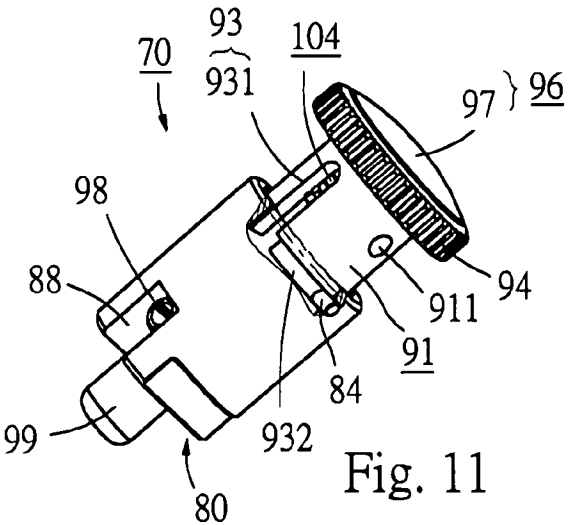
FIG. 11 is a perspective partially sectional view of the press button unit of still another embodiment of the present invention.
Figure 12:
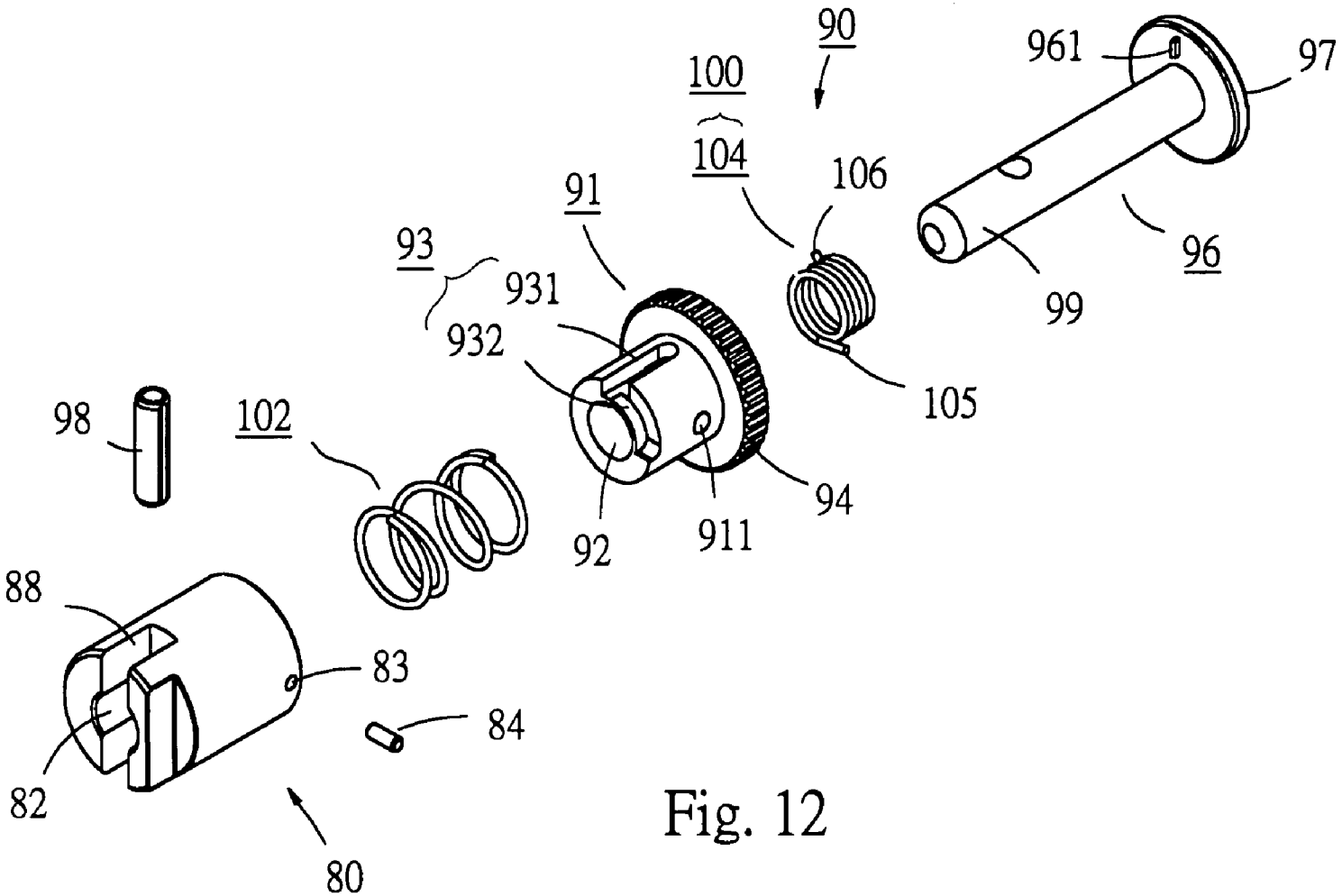
FIG. 12 is a perspective exploded view according to FIG. 11.

FIGS. 11 and 12 show the press button unit 70 of still another embodiment of the present invention, including a button seat, a press button member and a resilient mechanism.

The button seat 80 has a tunnel 82 passing through the button seat 80 from inner end to outer end thereof. A guide pin 84 is inserted in a hole 83 of the button seat 80. An inner end of the guide pin 84 extends into the button seat.

Figure 13:
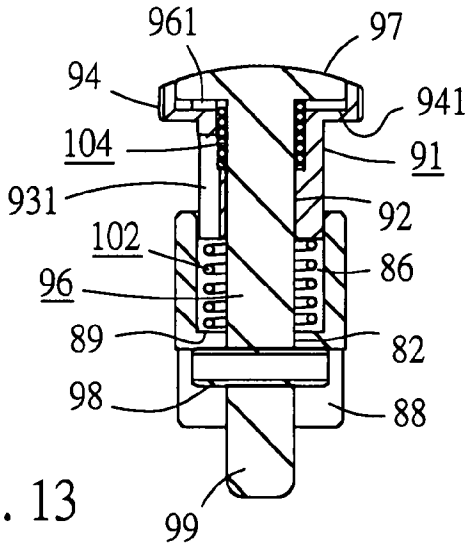
FIG. 13 is a longitudinal sectional view according to FIG. 11.

The press button member 90 includes a cylindrical body 91 and a button stem 96. The cylindrical body 91 has an axial through hole 92. A guide slot 93 is formed on the circumferential wall of the cylindrical body 91. The guide slot 93 includes a straight part 931 and a transverse part 932 connected with rear end of the straight part. The button stem 96 is fitted through the through hole 92 of the cylindrical body 91. Two ends of the button stem 96 respectively protrude from two ends of the cylindrical body 91. A cap portion 94 of the cylindrical body is formed with a dent 941. The cap portion 97 of the button stem is accommodated in the dent 941 as shown in FIG. 13. The press button member 90 is mounted into the button seat from outer end thereof, and is movable within the button seat 80. The cap portion 94 of outer end of the cylindrical body is exposed to outer side of the outer end of the button seat. The stem body of the button stem extends through the tunnel 82 of the button seat 80. The inner end of the stem body protrudes from inner end of the button seat. The guide pin 84 is positioned in the guide slot 93 as shown in FIG. 11. A restricting member 98 which is a pin is inserted through the stem body of the button stem and inlaid in an insertion split 88 of inner end of the button seat. Accordingly, the button stem can only axially move without possibility of rotation. The cylindrical body can be rotated about the button stem.

The resilient mechanism 100 includes a compression spring 102 and a torque spring 104. The compression spring 102 is mounted in a cavity 86 of the button seat 102 as shown in FIG. 13. Two ends of the compression spring 102 respectively abut against a shoulder 89 formed in the button seat and rear end of the cylindrical body 91, whereby the press button member tends to move toward outer end of the button seat. The torque spring 104 is fitted on the stem body 99 of the button stem 96 between the cylindrical body 91 and the button stem. One end 105 of the torque spring 104 is inserted in an orifice 911 of the cylindrical body, while the other end 106 of the torque spring is located at a boss 961 of rear face of the cap portion of the button stem 96. The torque spring serves to keep the cylindrical body in a specific angular position in normal state.

The press button unit 90 is mounted in the housing of the grinder for seizing the rotary shaft. This is similar to the state of FIGS. 1 and 2 and will not be further described hereinafter.

In normal state, the compression spring 102 pushes the press button member 90 and keeps it in the releasing position. In this state, the restricting member 98 of the press button member abuts against bottom end of the insertion split 88 of the button seat to locate the press button member. Also, the torque spring 104 locates the cylindrical body 91 in a specific angular position, that is, a security position, and the guide pin 84 abuts against a free end of the transverse part 932 of the guide slot 93 to locate the cylindrical body 91.

Figure 14:
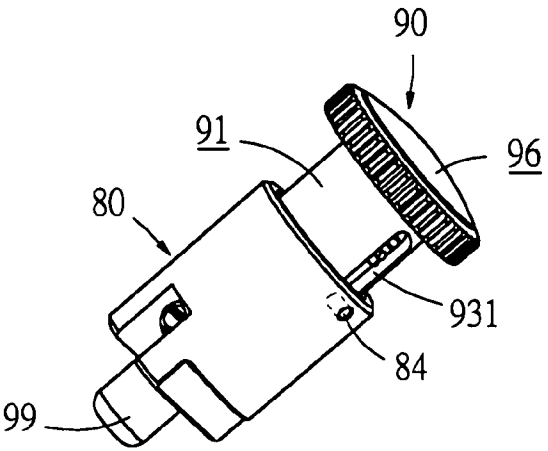
FIGS. 14 and 15 show the operation of the press button unit of FIG. 11.
Figure 15:
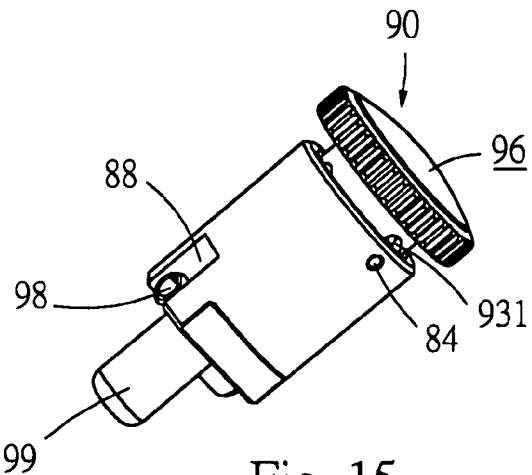

When operating the press button unit, first, a user turns the cylindrical body 91 to an operation position as shown in FIG. 14. In the operation position, the guide pin is moved to the other end of the transverse part 932, that is, the rear end of the straight part 931, where the guide pin 84 is aligned with the straight part 931 of the cylindrical body. Then, the user can press the press button member 90 toward the inner end of the button seat 80, and the member 90 is moved to the seizing position as shown in FIG. 15. At this time, the inner end of the button stem 96 is inserted into the bevel gear to fix the rotary shaft.

After the grinding disc is replaced, the press button is released from the pressing force. The compression spring 102 restores the press button member to the releasing position and the torque spring 104 restores the cylindrical body 91 from the operation position to the security position as shown in FIG. 11.

Referring to FIG. 11, in normal state, the inner end of the cylindrical body 91 is stopped by the guide pin 84 so that a user cannot directly press and move the press button member. Only when the cylindrical body is turned to the operation position, the user can press down the press button member. Accordingly, mis-touch can be avoided.

Figure 16:
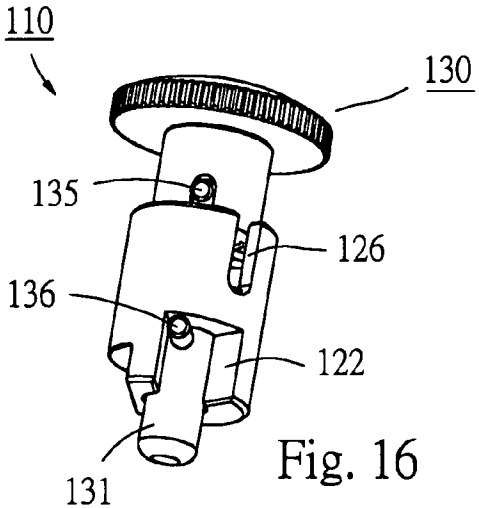
FIG. 16 is a perspective view of the press button unit of still another embodiment of the present invention.
Figure 17:
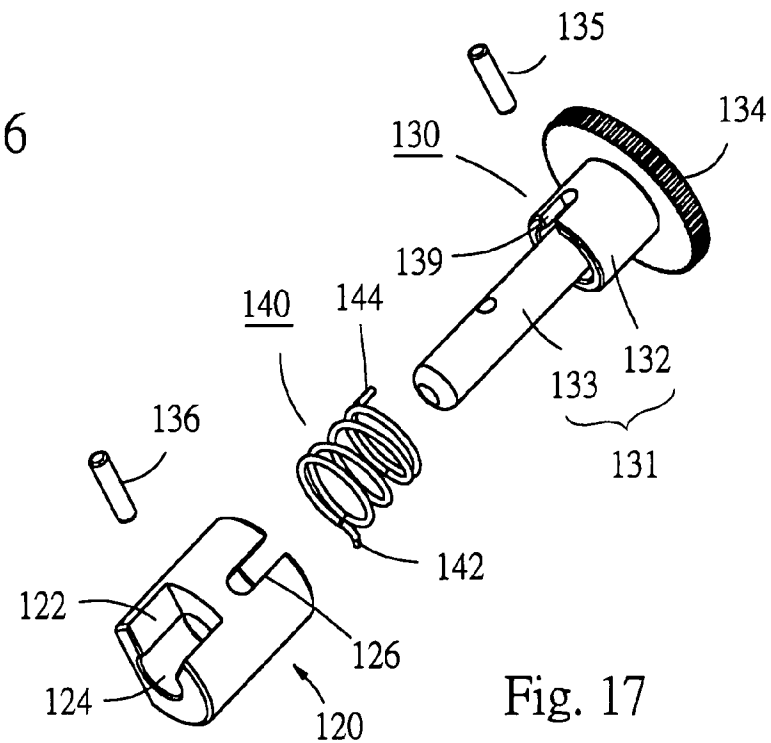
FIG. 17 is a perspective exploded view of the press button unit of FIG. 16.

FIGS. 16 and 17 show the press button unit 110 of still another embodiment of the present invention.

The circumferential wall of inner end of the button seat 120 is formed with a notch 122 with a certain width. The notch 122 communicates with the tunnel 124. The outer end of the button seat 120 is formed with a guide slot 126 inward extending from outer end thereof and communicating with the tunnel 124.

The press button member is a button stem 130 having a stem body 131. The stem body 131 includes a large diameter part 132 and a small diameter part 133. The large diameter part 132 is adjacent to the cap portion 134 of the button stem. A guide pin 135 is inserted in the stem body 131. A restricting member 136 which is a pin is inserted in the stem body. The button stem 130 is fitted in the tunnel 124 of the button seat 120. The button stem 130 is movable along the button seat and is also rotatable within the button seat. The restricting member 136 is positioned in the notch 122 of the button seat for restricting the rotational angle of the button stem.

Figure 18:
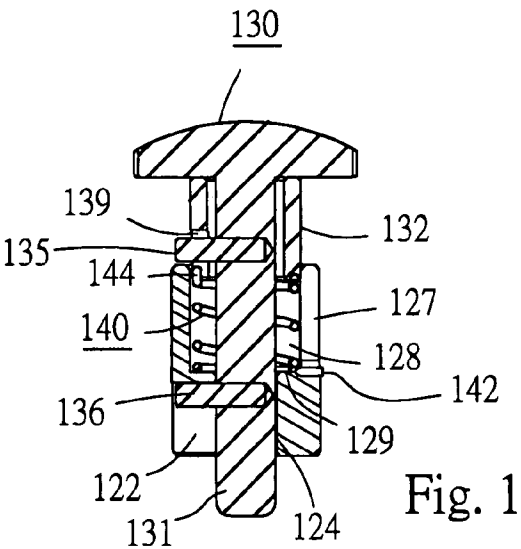
FIG. 18 is a longitudinal sectional view according to FIG. 16.

The resilient mechanism is a spring 140 serving as both a compression spring and a torque spring. The spring 140 is fitted on the stem body 131 of the button stem and received in the cavity 128 of the button seat as shown in FIG. 18. One end 142 of the spring is located in an insertion slot 127 of the button seat and connected with the button seat 120. The other end 144 of the spring is located in an insertion slot 139 of the button stem 130 and connected with the button stem. Two end faces of the spring 140 respectively abut against a shoulder 129 formed in the button seat and the large diameter part 132 of the button stem. The torque of the spring 140 makes the button stem angularly displace within the button seat to a security position. The restricting member 136 abuts against one side of the notch 122 of the button seat.

In normal state, the press button unit 110 is positioned in a releasing position as shown in FIG. 16, where the guide pin 135 is positioned at outer end of the button seat 120 and not aligned with the guide slot 126. When operated, the button stem 130 is first turned from the security position of FIG. 16 to the operation position of FIG. 19. At this time, the restricting member 136 is positioned on the other side of the notch 122 and the guide pin 135 is aligned with the guide slot 126. Then the button stem 130 can be pressed to axially move to the seizing position of FIG. 20 for seizing the rotary shaft of the grinder.

Figure 19:
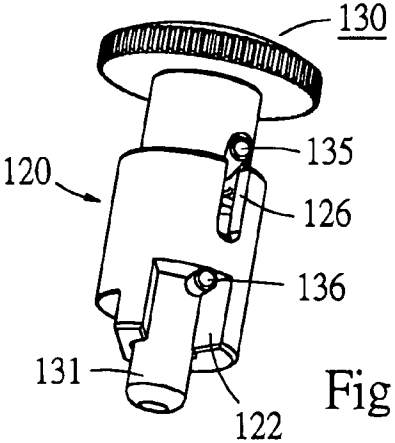
FIGS. 19 and 20 show the operation of the press button unit of FIG. 16.
Figure 20:
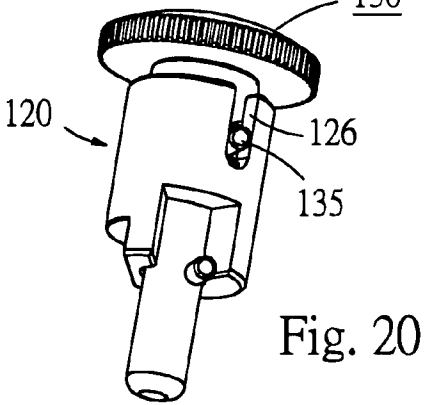

After releasing the applied force, the spring 140 first pushes the button stem 130 to axially move along the button seat 120, and the button is restituted to the operation position of FIG. 19. At this time, the guide pin 135 is out of the guide slot 126. The torque of the spring 140 then turns the button stem 130 and the button stem is angularly displaced from the operation position of FIG. 19 to the security position of FIG. 16. The rotary shaft is no more seized.

Figure 21:
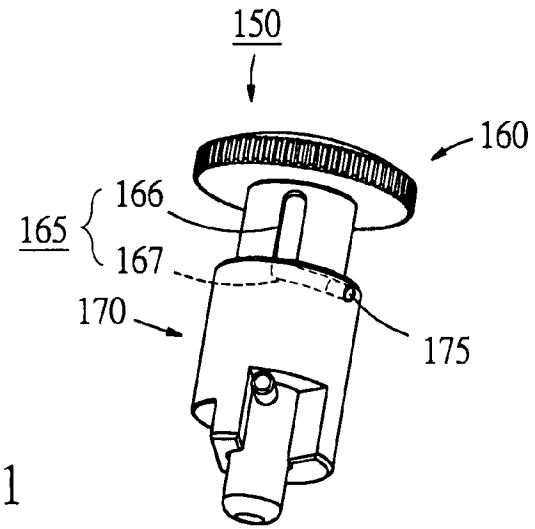
FIG. 21 is a perspective view of the press button unit of still another embodiment of the present invention.
Figure 22:
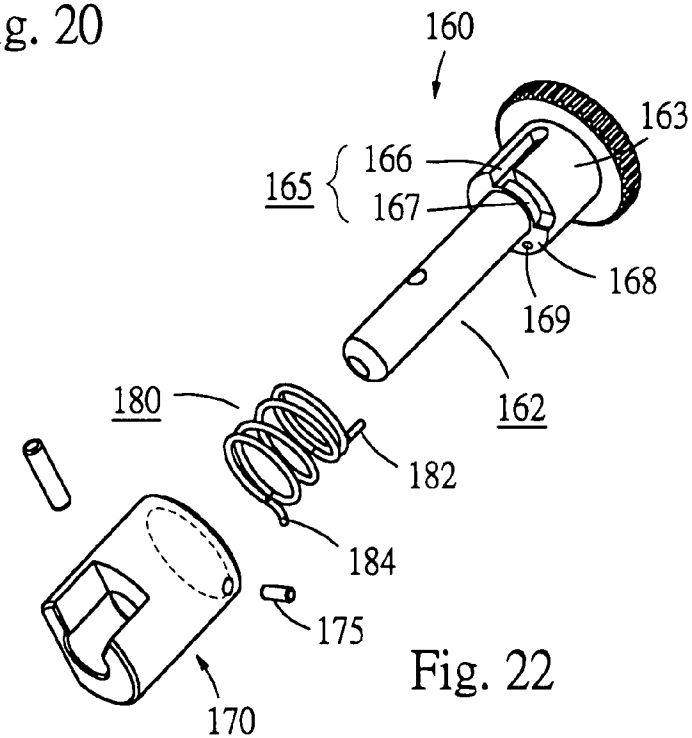
FIG. 22 is a perspective exploded view of the press button unit of FIG. 21.

FIGS. 21 and 22 show the press button unit 150 of still another embodiment of the present invention. The circumference of the large diameter part 163 of the stem body 162 of the button stem 160 is formed with a guide slot 165. The guide slot 165 includes a straight part 166 and a transverse part 167. The button stem is fitted through the button seat 170. A guide pin 175 is inserted in the button seat 170. The guide pin 175 extends into the button seat 170 and positioned in the guide slot 165. A spring 180 serving as both a compression spring and a torque spring is mounted in the cavity 176 of the button seat. Two end faces of the spring 180 respectively abut against a shoulder formed in the button seat and a shoulder 168 of the button stem for pushing the button stem. One end 182 of the spring is inserted in an insertion hole 169 of the button stem, while the other end 184 of the spring is fixed inside the button seat for rotating the button stem to a security position.

The operation of this embodiment is identical to the embodiment of FIG. 11.

In conclusion, the grinder of the present invention is equipped with a press button unit. Before axially pressing the press button, a user must first angularly displace the press button. Therefore, mis-touch of the press button can be avoided so as to avoid damage of the grinder.

The above embodiments are only used to illustrate the present invention, not intended to limit the scope thereof. Many modifications of the above embodiments can be made without departing from the spirit of the present invention.

What is claimed is:

1. A grinder comprising:

a housing;

a rotary shaft rotatably disposed in the housing; and a press button unit including:

a button seat;

a press button member fitted in the button seat, two ends of the press button member respectively protruding from two ends of the button seat, the press button member being axially movable along an axis of the button seat, whereby the press button member is selectively moved toward an inner end of the button seat into an engaging position engaging the rotary shaft to stop rotation thereof, and moved toward an outer end of the button seat and located in a releasing position separated from the rotary shaft; and a resilient mechanism disposed between the button seat and the press button member, the resilient mechanism serving to resiliently keep the press button member in the releasing position; the press button unit being mounted on the housing, whereby by means of pressing the outer end of the press button member, when the press button member moves axially from the releasing position to the engaging position, the press button member rotates within the button seat allowing the press button member to move from the releasing position to the engaging position, when the press button member does not rotate, the press button member remains in the releasing position.

2. A grinder comprising:

a housing;

a rotary shaft rotatably disposed in the housing, a bottom end of the rotary shaft being for mounting a grinding disc; and a press button unit including:

a button seat formed with a tunnel passing through the button seat from an inner end to an outer end thereof;

a press button member fitted through the tunnel of the button seat, two ends of the press button member respectively protruding from two ends of the button seat, the press button member being axially movable along an axis of the button seat and rotatable within the button seat, whereby the press button member is selectively moved toward an outer end of the button seat and located in a releasing position and moved toward an inner end of the button seat into an engaging position engaging the rotary shaft; when the press button seat is located in the releasing position, the press button member is rotated between a security position and an operation position; when the press button member is rotated from the security position to the operation position, the press button member being movable from the releasing position to the engaging position; and a resilient mechanism having both compressional and torsional elastic functions, the resilient mechanism being disposed between the button seat and the press button member, whereby when the press button member is free from any external force, the resilient mechanism serves to resiliently push the press button member toward the releasing position and turn the press button member toward the security position;

the press button unit being mounted in the housing, whereby when the press button member is positioned in the engaging position, the press button member engages the rotary shaft to stop rotation thereof.

3. The grinder as claimed in claim 2, wherein a circumference of the press button member is formed with a guide slot including a straight part and a transverse part, one end of the transverse part being connected with a rear rend of the straight part; a guide pin being disposed on the button seat, the guide pin extending into the button seat, an inner end of the guide pin being positioned in the guide slot, whereby when the press button member is positioned in the security position, the guide pin is located at a free end of the transverse part of the guide slot.

4. The grinder as claimed in claim 3, wherein the resilient mechanism is a spring serving as both a compression spring and a torque spring, the spring being disposed between the button seat and the press button member, two end faces of the spring respectively abutting against the press button member and the button seat, two ends of the spring being respectively connected with the button seat and the press button member.

5. The grinder as claimed in claim 3, wherein the press button member includes a cylindrical body and a button stem, the cylindrical body having an axial through hole; the guide slot being formed on a circumferential wall of the cylindrical body; the button stem being fitted through the through hole of the cylindrical body, two ends of the button stem respectively protruding from two ends of the cylindrical body; the cylindrical body and the button stem being mounted in the button seat and together movable between the releasing position and the seizing position, the button stem being movable along an axis of the button seat without possibility of rotation; the cylindrical body can be annularly displaced between the security position and the operation position when it is positioned in the releasing position; the resilient mechanism including a compression spring and a torque spring, the compression spring being mounted between the button seat and the cylindrical body for pushing the cylindrical body and keeping the press button member in the releasing position; the torque spring being mounted between the button stem and the cylindrical body for keeping the cylindrical body in the security position.

6. The grinder as claimed in claim 5, wherein an inner end of the button seat is formed with an insertion split and a restricting member is disposed at inner end of the button stem, whereby the restricting member is inserted in the insertion split.

7. The grinder as claimed in claim 2, wherein a circumferential wall of the button seat is formed with a longitudinal guide slot communicating with an interior of the button seat; the press button member being a button stem having a stem body, a guide pin being inserted in the stem body; whereby when the button stem is positioned in the security position, the guide pin is not aligned with the guide slot, while when the button stem is positioned in the operation position, the guide pin is right aligned with the front end of the guide slot.

8. The grinder as claimed in claim 7, wherein an inner end of the button seat is formed with a notch with a certain width; a restricting member being disposed at inner end of the button stem and positioned in the notch, whereby the restricting member can be turned between two sidewalls of the notch, which serve as two dead ends of the angular displacement travel of the button stem.

9. The grinder as claimed in claim 7, wherein the resilient mechanism is a spring serving as both a compression spring and a torque spring, the spring being disposed between the button seat and the button stem, two end faces of the spring respectively abutting against the button seat and the button stem, two ends of the spring being respectively connected with the button seat and the button stem.

10. The grinder as claimed in claim 4, wherein a cavity is formed in the button seat and coaxial with the tunnel, the cavity having a larger diameter;

the resilient mechanism being disposed in the cavity.

11. The grinder as claimed in claim 9, wherein a cavity is formed in the button seat and coaxial with the tunnel, the cavity having a larger diameter; the resilient mechanism being disposed in the cavity.

12. A grinder comprising:

a housing;

a rotary shaft rotatably disposed in the housing, a bottom end of the rotary shaft being for mounting a grinding disc; and a press button unit including:

a button seat formed with a tunnel passing through the button seat from an inner end to an outer end thereof; a guide slot being formed on a circumferential wall of the button seat and communicating with an interior of the button seat, a front end and a rear end of the guide slot being displaced from each other both in axial direction and in radial direction of the button seat;

a button stem having a stem body, a guide pin being inserted in the stem body, the button stem being fitted through the tunnel of the button seat, two ends of the button stem respectively protruding from two ends of the button seat; the guide pin being received in the guide slot; and a resilient mechanism disposed between the button seat and the button stem for resiliently pushing the button stem toward outer end of the button seat into a releasing position where the guide pin is located at the front end of the guide slot; whereby after the button stem is angularly displaced by a certain angle, the button stem is moved along an axis of the button seat from the releasing position toward inner end of the button seat into an engaging position where the guide pin is moved along the guide slot to the rear end of the guide slot;

the press button unit being disposed in the housing, whereby when the button stem is positioned in the engaging position, the button stem engages the rotary shaft to stop rotation thereof.

13. The grinder as claimed in claim 12, wherein a restricting portion is formed on a rear wall of the guide slot near the front end of the guide slot, whereby only after the button stem is angularly displaced to make the guide pin pass over the restricting portion, the button stem is moved to the engaging position.

14. The grinder as claimed in claim 13, wherein the restricting portion and the front end of the guide slot define therebetween a depression.

15. The grinder as claimed in claim 12, wherein the guide slot includes an arc part and a straight part which is located at a rear section of the guide slot.

16. The grinder as claimed in claim 13, wherein the guide slot includes an arc part and a straight part which is located at a rear section of the guide slot.

17. The grinder as claimed in claim 12, wherein the guide slot is an arc slot.

18. The grinder as claimed in claim 13, wherein the guide slot is an arc slot.

* * * * *